US008555509B2

(12) United States Patent
Pohl et al.

(10) Patent No.: US 8,555,509 B2
(45) Date of Patent: Oct. 15, 2013

(54) SHAVING UNIT FOR AN ELECTRIC SHAVER

(75) Inventors: Thorsten Pohl, Muehlheim (DE); Joachim Krauss, Pfungstadt (DE); Tobias Schwarz, Schmitten (DE); Peter Junk, Schmitten (DE); Reinhold Eichhorn, Idstein (DE); Andreas Peter, Kronberg (DE); Michael Odemer, Niddatal (DE); Martin Fuellgrabe, Bad Camberg (DE); Christoph Zegula, Roedermark (DE); Alois Koeppl, Weilrod (DE); Stefan Fuerst, Kronberg (DE)

(73) Assignee: Braun GmbH, Kronberg (DE)

( * ) Notice: Subject to any disclaimer, the term of this patent is extended or adjusted under 35 U.S.C. 154(b) by 257 days.

(21) Appl. No.: 13/193,644

(22) Filed: Jul. 29, 2011

(65) Prior Publication Data

US 2012/0055026 A1 Mar. 8, 2012

(30) Foreign Application Priority Data

Sep. 3, 2010 (EP) ..... 10009209

(51) Int. Cl.
*B26B 19/02* (2006.01)

(52) U.S. Cl.
USPC ..... 30/43.92; 30/43

(58) Field of Classification Search
USPC ..... 30/43–43.92, 45
See application file for complete search history.

(56) References Cited

U.S. PATENT DOCUMENTS

| | | | | |
|---|---|---|---|---|
| 2,240,264 | A | 4/1941 | Muros | |
| 2,279,102 | A | 4/1942 | Dobson | |
| 2,298,962 | A | 10/1942 | Murphy | |
| 2,325,267 | A | 7/1943 | Murphy | |
| 2,706,332 | A | 4/1955 | Murphy | |
| 2,859,513 | A | 11/1958 | Bylund | |
| 4,081,902 | A * | 4/1978 | Locke | 30/43.92 |

(Continued)

FOREIGN PATENT DOCUMENTS

| | | |
|---|---|---|
| DE | 1111062 B | 7/1961 |
| DE | 2841692 A1 | 4/1980 |
| EP | 1930135 A1 | 6/2008 |

OTHER PUBLICATIONS

International Search Report dated Jan. 31, 2011, 3 pgs.

(Continued)

*Primary Examiner* — Sean Michalski
(74) *Attorney, Agent, or Firm* — David K Mattheis; Kim W Zerby

(57) ABSTRACT

A shaving unit for an electric shaver which comprises an outer cutter and an inner cutter associated to that outer cutter. The cutters are mounted so as to be movable relative to each other and adapted to be set in a relative motion by a drive mechanism. The inner cutter provides a plurality of cutting edges and abuts with its outer face on the inner face of the outer cutter. The outer cutter provides a plurality of teeth equipped with cutting edges. The outer cutter provides two comb elements which are disposed opposite one another and which extend according to the direction of the relative motion. The two comb elements are aligned with respect to one another such that the tips of the teeth of the first comb element are facing the tips of the teeth of the second comb element, the tips of the teeth spaced from one another.

12 Claims, 7 Drawing Sheets

(56) References Cited

U.S. PATENT DOCUMENTS

| | | | | |
|---|---|---|---|---|
| 4,274,199 | A | 6/1981 | Gallanis et al. | |
| 4,393,586 | A | 7/1983 | Hamashima et al. | |
| 4,896,420 | A * | 1/1990 | Locke | 30/34.2 |
| 5,669,138 | A * | 9/1997 | Wetzel | 30/43.92 |
| 5,946,806 | A * | 9/1999 | Watanabe et al. | 30/43.92 |
| 6,178,641 | B1 * | 1/2001 | Meijer | 30/43.92 |
| 6,293,017 | B1 * | 9/2001 | Sato et al. | 30/43.92 |
| 7,490,408 | B2 * | 2/2009 | Eichhorn et al. | 30/34.1 |
| 2004/0055158 | A1 | 3/2004 | Izumi et al. | |
| 2005/0016002 | A1 | 1/2005 | Fukutani et al. | |
| 2007/0130774 | A1 * | 6/2007 | Eichhorn et al. | 30/34.1 |
| 2008/0216320 | A1 * | 9/2008 | Royle et al. | 30/34.1 |
| 2010/0139098 | A1 * | 6/2010 | Kuijper et al. | 30/45 |
| 2010/0175258 | A1 | 7/2010 | Kleine Doepke et al. | |
| 2011/0016723 | A1 * | 1/2011 | Maichel et al. | 30/45 |
| 2011/0209350 | A1 * | 9/2011 | Eichhorn et al. | 30/43.7 |
| 2012/0055025 | A1 * | 3/2012 | Pohl et al. | 30/34.1 |
| 2012/0055026 | A1 * | 3/2012 | Pohl et al. | 30/43.6 |

OTHER PUBLICATIONS

International Search Report dated Jan. 28, 2011, 3 pgs.
U.S. Appl. No. 13/193,648, filed Jul. 29, 2011, Thorsten Pohl et al.

* cited by examiner

SHAVING UNIT FOR AN ELECTRIC SHAVER

FIELD OF THE INVENTION

This invention relates to a shaver unit for an electric shaver according to the generic part of claim 1. Shaving units of this kind are designated to be used in electric shavers, beard trimmers and hair cutters. They can be arranged as a sole cutting element or in combination with other cutting elements—often they are used as so-called center trimmers and arranged between two shaving foils.

BACKGROUND OF THE INVENTION

Shaving units of the type initially referred to are known for example from EP 0693988 B1. This document discloses an electric dry shaver where a center trimmer is arranged between two foil type shaving elements. The upper cutter of this center trimmer is provided with hair feeding means consisting of projecting teeth which are directed outwardly. Those center trimmers in general are rather effective in cutting the hairs to a very short remaining length of hair. With respect to hairs which are resting flat against the skin the performance of the known cutting system is not optimal since such hairs—especially if they are located on skin areas with flexible skin—tend to escape from the feeding area formed between two teeth of the comb-shaped feeding means.

From the EP 1930135 A1 there is known a shaving head with a center trimmer which comprises a multiplicity of bars arranged at a small distance to each other, so as to form small slits between the bars. Such kinds of center trimmers are a more open construction without a center bar arranged along the longitudinal axis of the trimmer. Cutting units of this type have proven to be mechanically stable even with a small thickness of the outer cutter. The drawback of this kind of shaving units is the risk to cause skin irritations.

SUMMARY OF THE INVENTION

It is an objective of the present invention to provide an improved shaving unit for electric shavers of the type initially referred to such to ensure an optimal feeding of hairs as well as to avoid skin irritation during the shave.

This objective is accomplished by the combination of features as indicated in claim 1.

According to the invention, the outer cutter provides two comb elements each directed inwardly. This inventive solution enables a high mechanical stability in combination with providing extremely thin comb elements, which consequently ensure an optimal lifting of hairs that are lying flat to the skin. A thin outer cutter additionally enhances a close shave because the cutting area between the inner and the outer cutter can be placed extremely narrow to the skin. The central area of the upper cutter between the inwardly directed teeth of the comb elements provides a high likelihood for hairs to be lifted from the skin.

In an embodiment of the present invention increasing the probability of catching as well as lifting hairs, the teeth of the first comb element are arranged offset in relation to the teeth of the second comb element along a direction of the relative motion. In a particularly advantageous embodiment of the invention the pitch of the teeth of the two comb elements is equal and the teeth of the first comb element are provided offset in relation to the second comb element by half of the pitch. This enables a longer free distance in front of the tips and helps feeding the hairs to be cut.

Another embodiment of the invention that helps both to completely avoid skin irritation during and after shaving and to capture flat hairs is characterized in that the teeth of the first and of the second comb element are designed such that their surfaces which contact the skin during the shaver lie in one plane. Another embodiment that is characterized by a superior performance of feeding hairs resting flat against the skin may be realized in a way that the teeth of the first and second comb elements each lie in planes that extend at an angle of 180-120 degrees to each other. Especially a difference in height of up to a maximum of 250 μm between the tips of the teeth and the respective opposite ends of the teeth—which means that the tips are upwardly elevated—is an optimal compromise which guarantees both extremely effective feeding performance with respect to hairs which are lying flat to the skin and avoidance of irritation of the skin. This is because during the shaving strokes this geometry leads to a deformation of the skin also in that range of 250 μm. This, in turn, makes it highly likely for the prong-shaped teeth to under slide and to then lift stubbles of a length of some 100 μm.

It has turned out that a distance between facing teeth tips of approximately 0.7 to 1.6 millimeters assures high shaving comfort as well as excellent feeding of hairs, even in case of a beard having grown for several days.

During a continuous shaving stroke the skin remains tensioned and stretched in the area of the gap between the facing teeth tips. However, when reversing the direction of the stroke the skin tends to penetrate into the gap due to the fact that skin folds may occur caused by peaks of the contact pressure between skin and shaver. Therefore, it is advantageous that the inner cutter is provided with a recess in its area between the tips of the teeth of the outer cutter. It is additionally beneficial to avoid sharp edges on the inner cutter in said area.

The inventive shaving unit may be incorporated in both linear/translational oscillating and rotatory shaving systems. This means that the relative motion of the inner and outer cutter may be a translational oscillating motion along the longitudinal axis of the shaving unit or a rotatory motion around the perpendicular axis of an annular-shaped shaving unit.

If at least one of the two comb elements is provided with a bar arranged opposite the tips of the teeth, the possibility of catching skin in a slit between two teeth is drastically reduced. Furthermore, if a hair lying flat, i.e. nearly parallel to the skin is fed between two teeth and then during the shaving stroke is pressed with its free end against this bar, there is a certain likelihood of leveraging the hair away from the skin and moving it deeper into the shaving unit to cut it.

The invention also concerns a shaving head whereby at least one shaving unit as described above is arranged, especially in combination with additional shaving units of the same type or of other types.

BRIEF DESCRIPTION OF THE DRAWINGS

The invention will be further elucidated by detailed explanation of exemplary embodiments and by reference to figures. In the figures

DETAILED DESCRIPTION OF THE INVENTION

Figure 1:
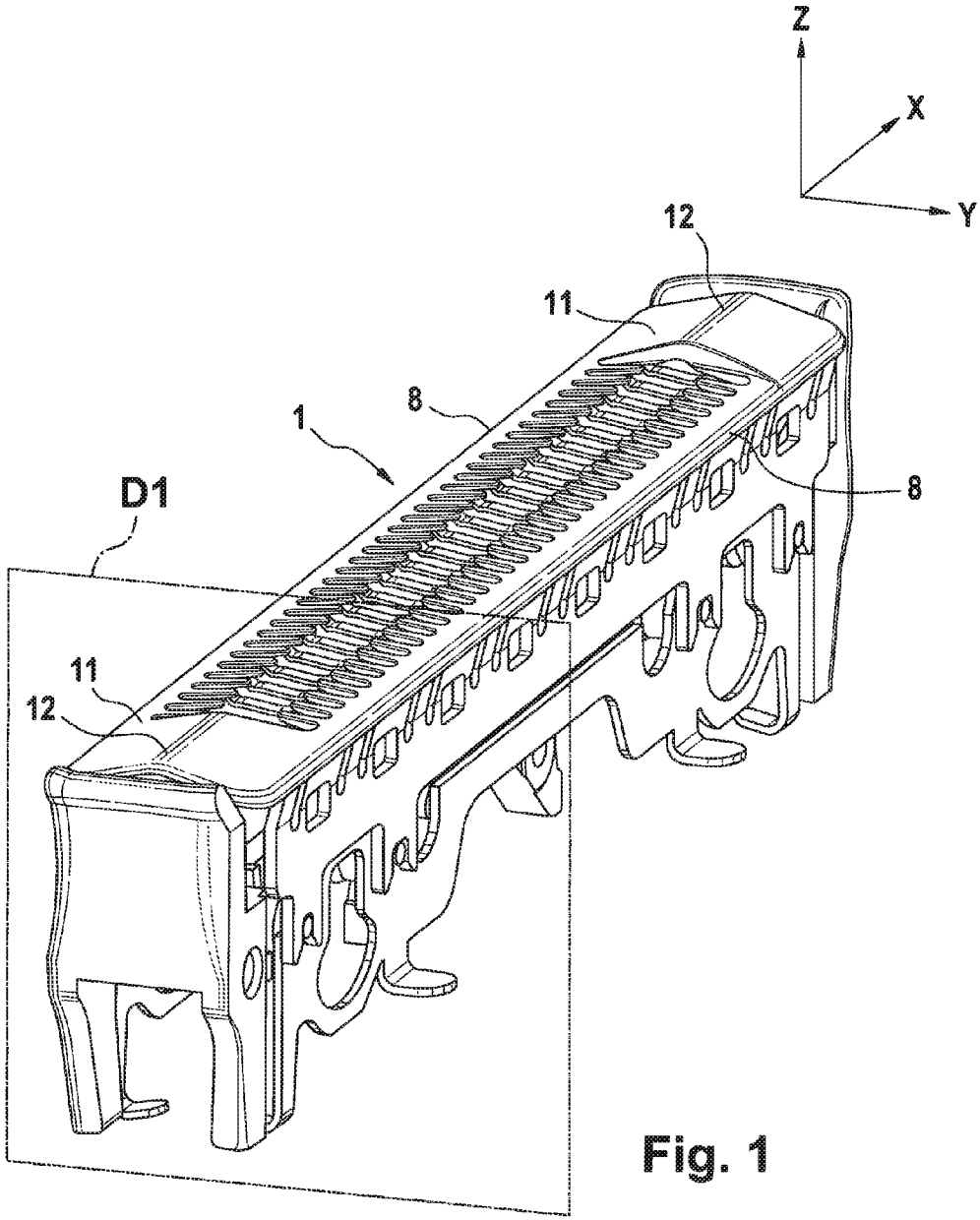
FIG. 1 is a perspective illustration of an exemplary embodiment of the invention.
Figure 2:
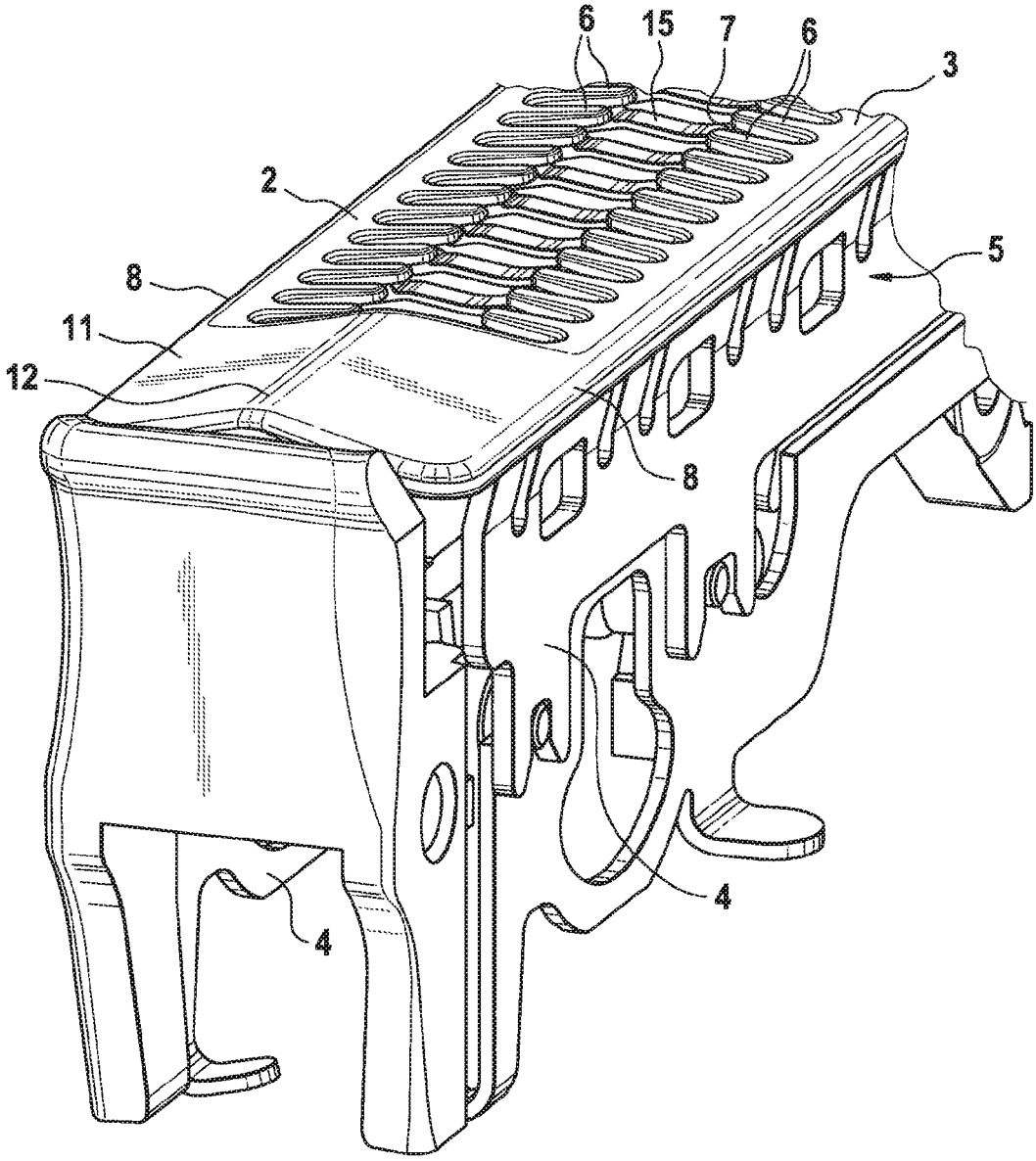
FIG. 2 shows detail D1 of FIG. 1 in a larger scale.

FIG. 1 shows an embodiment of a shaving unit 1 according to the invention, having a longitudinal axis X, a lateral axis Y and vertical axis Z. In the enlarged view, as depicted in FIG. 2, there is shown the outer cutter 5 which consists essentially of the first comb element 2, the second comb element 3 and the sidewalls 4 which parts all together compose the U-shaped form of the outer cutter 5. In the embodiment according to FIG. 2, the two comb elements 2 and 3 are arranged in a way that they run towards each other at an angle, whereby top faces of the comb elements which contact the skin during shaving increase in height from their outer borders 8 going inwards to shape a roof-form with an elevated middle part. For identical parts or parts which accord each other the same reference numbers are used in the description.

Figure 3:
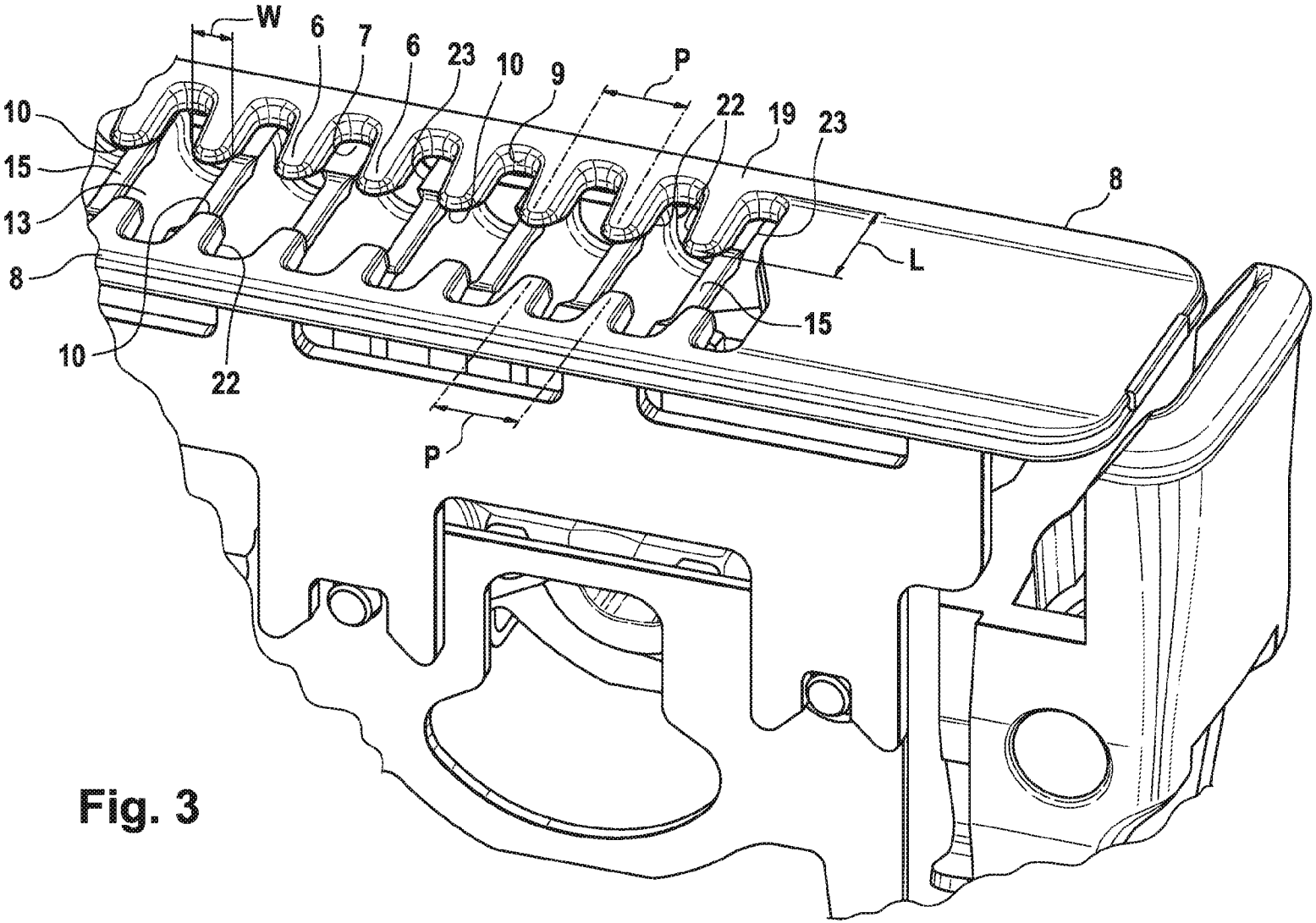
FIG. 3 is another perspective illustration of an embodiment of the invention.

As can be taken best from FIGS. 1-3, the two comb elements 2, 3 are integrally formed and comprise a multiplicity of teeth 6 arranged at regular intervals. The respective pitch P is 0.9 mm. The teeth 6 extend inwardly in parallel to the lateral axis Y and have a length of 1.2 mm measured from the tooth root surface 9 to the tip 10. The distance from the outer border 8 to the tip 10 is 2.25 mm. Every tooth has a width W measured along the longitudinal axis X of around 0.5 mm (500 μm) which—under calculating with the pitch P value of 0.9 mm—gives a value of the slit 7 between two teeth 6 of around 0.4 mm. The overall width of the shaving unit 1 (along lateral axis Y) is 5.5 mm and its length along the longitudinal axis X is 41 mm. The two end sections 11 of the shaving unit 1 which delimit the section where the teeth 6 are arranged have a plane surface without any tooth. The two end sections 11 may be provided with a relief-like structure for interacting with the user's skin or it may be perforated. The perforation of the end sections 11 positively impacts the process of bending the integrally formed two comb elements 2, 3 along the common symmetry line 12 parallel to the longitudinal axis X. This bending is for providing an obtuse angle A between the two comb elements 2, 3. This topic and the advantages associated therewith will be described below, especially in connection with FIGS. 5 and 6.

Figure 4:
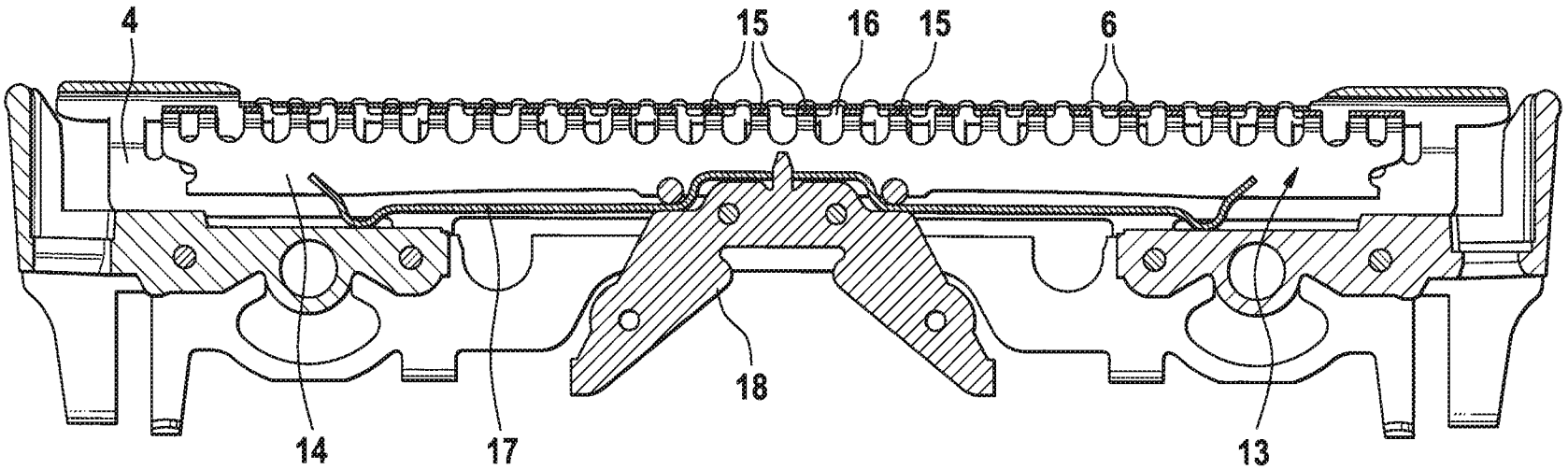
FIG. 4 shows a cross-section along the longitudinal axis of a shaving unit according to FIG. 3.

The outer cutter 5 encompasses the inner cutter 13 which also is U-shaped. It is composed of two side walls 14 which are interconnected by a plurality of bars 15 whereby the single bars are arranged displaced from each other by a distance to form a plurality of slots 16 between two adjacent bars 15 (see FIG. 4). The bars 15 are arranged at regular intervals. The respective pitch is 1.5 mm. The bars have a width along the longitudinal axis X of around 0.7 mm which leads to a slot width of 0.8 mm. A leave spring 17 is arranged preloaded between the inner and the outer cutter 13, 5 to bias both parts against each other in a way that is known per se. The inner cutter 13 comprises coupling means 18 to be coupled in a known manner with an oscillating drive, which drive is not shown in the drawing. The outer cutter 5 is preferably fixed to a shaver head or a housing of an electric shaver, but might in a further embodiment of the invention (not shown) also be driven by a drive mechanism.

From FIG. 3 it can be taken that the first and second comb elements 2, 3 are providing the same pitch P of 0.9 mm. However, the two comb elements are parallel shifted by 0.45 mm—which is half of that pitch—against each other. Consequently the tips 10 of the first comb element 2 are located opposite the slits 6 of the second comb element 3.

Figure 5:
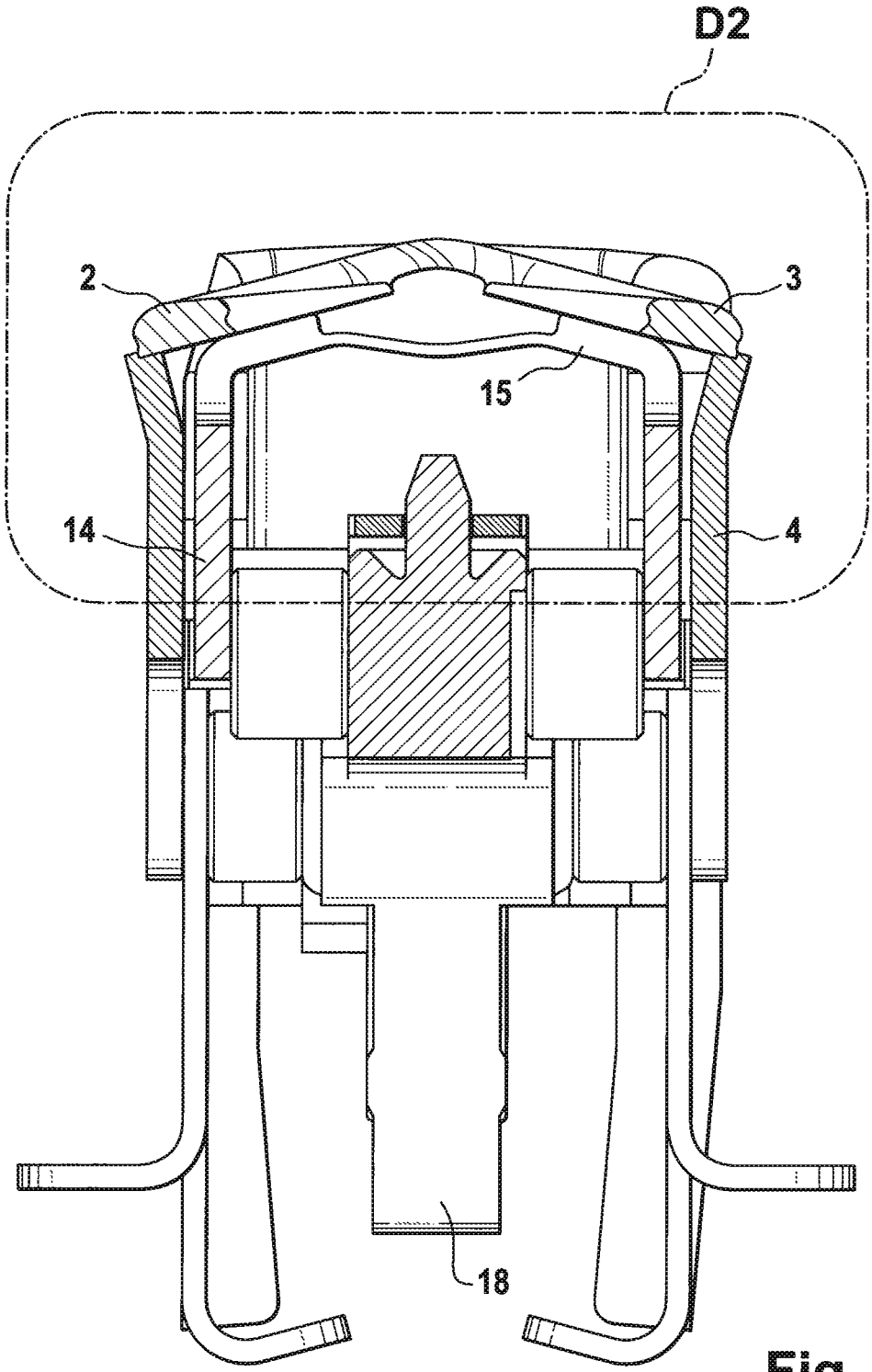
FIG. 5 is a cross-section along the lateral axis through an embodiment of the invention according to FIG. 2.
Figure 6:
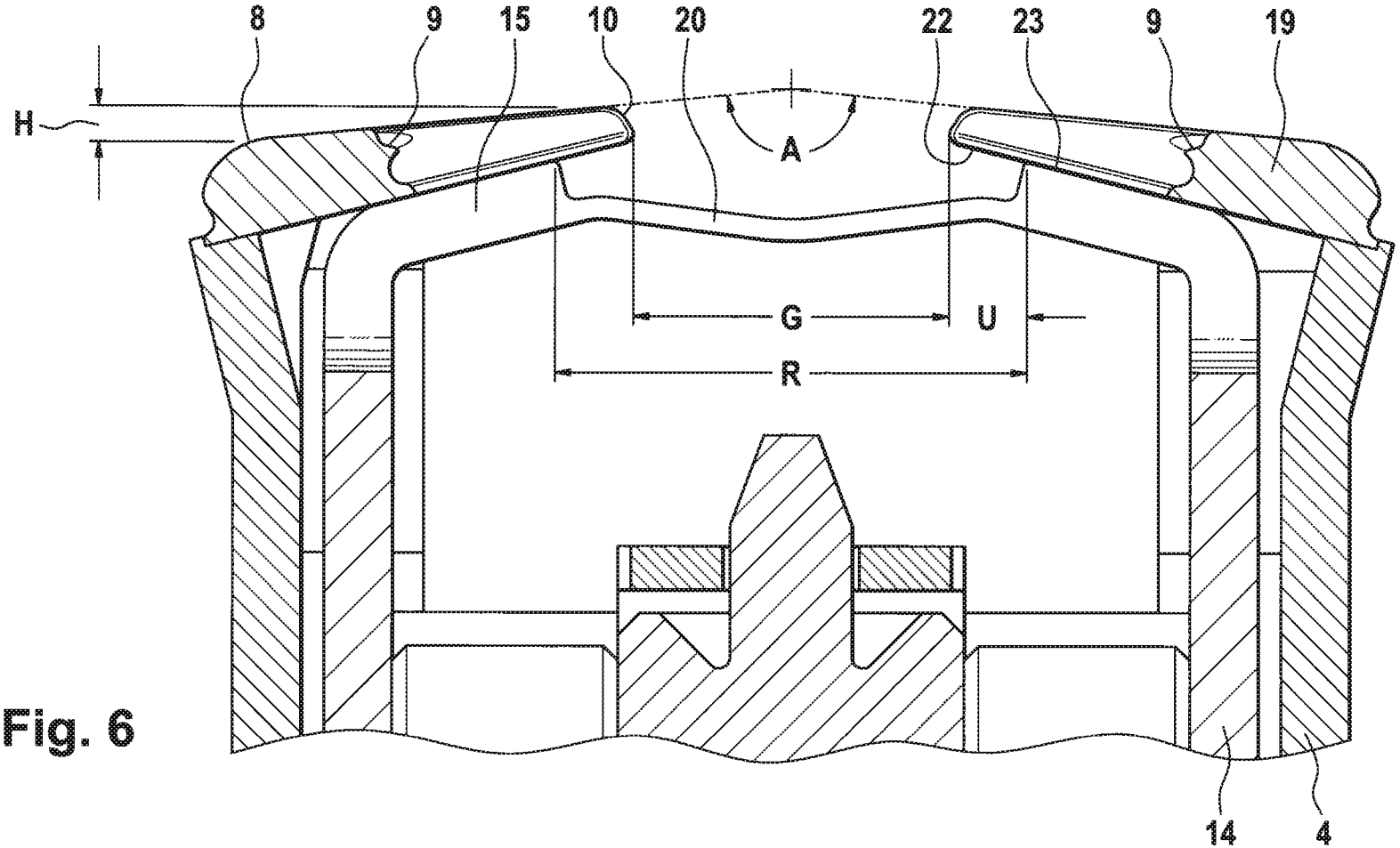
FIG. 6 depicts Detail D2 of FIG. 5 in a larger scale with omission of some details which are not important for the invention.

FIGS. 5 and 6 are showing a cross-section along the lateral axis through an embodiment of the invention according to FIG. 2 and are clearly demonstrating the obtuse angle A between the two comb elements 2 and 3. This angle A leads to a difference in height H between the outer border 8 and the tip 10 by an amount of 250 μm. The obtuse angle A between the two comb elements is produced by simply bending around the symmetry line 12 in the area of the end sections 11. Consequently the teeth 6 of the comb elements 2, 3 are brought into the angled position without getting touched by a bending tool.

The free gap G between the tips 10 of the first comb element 2 and their respective counterparts of the second comb element 3 is around 1.00 mm. The tooth length L—which is the distance from tip 10 to the tooth root surface 9—is 1.2 mm. The height of the teeth in dimension Z is 150 μm in the area of the tips 10 and increases linearly along the length L in direction to the tooth root surface 9 up to 400 μm. Since the distance from the outer border 8 to the tip 10 is 2.25 mm, the conjunction bar 19 has width of 1.05 mm. By this, a bending stiffness of the teeth 6 is achieved which is optimally adapted to the teeth's capacity to cope with pressure. In this way, it will be possible to realize extremely thin comb tips 10 by nevertheless maintaining the stability of the teeth 6. A tapering of the teeth 6 thickness towards the tips 10 is achieved by the removal of material at the underside of the teeth. It is true that there is an enhanced risk of skin irritations with extremely thin teeth, but the comb tips facing each other allow an optimal stretching of the skin, thus compensating for this risk.

The elevation of the tips 10 relative to the outer conjunction bars 19 causes a deformation of the skin in areas of flexible skin which helps lifting up flat lying hairs and directing them in a optimal alignment to then feed them into the cutting gaps defined by the slits 7 of the outer cutter 5 and the slots 16 of the inner cutter 13. The teeth 6 are—as known per se—equipped with cutting edges 22 at their lower side and the bars 15 provide cutting edges 23 at their upper side.

To avoid skin contact with the driven inner cutter 13 in case the skin during shaving is pressed into the free gap G the bar 15 is providing a recess 20 at the top surface of its middle section. Whereas the height of the bars 15 at the boundary area is about 0.3 mm the height at the recessed middle area 20 is only about 0.2 mm. In addition to this 0.1 mm recess, the middle area 20 of the bar 15 is provided with a concave top surface which delivers an additional free space in the vertical of about 0.1 mm in the center. The recess 20 extends over a total width R of 1.7 mm along the axis Y. Due to free gap G of 1.00 mm the undercut U (the extent from the tip 10 to the respective bound of the recess 20) is 0.35 mm. This undercut U in conjunction with the recess ensures the avoidance of skin irritations during the shave.

Due to the fact that the outer cutter 5 as well as the inner cutter 13 posses U-form profiles the shaving unit 1 is distinguished by a superior mechanical stability even though using parts of only minor material thickness.

Figure 7:
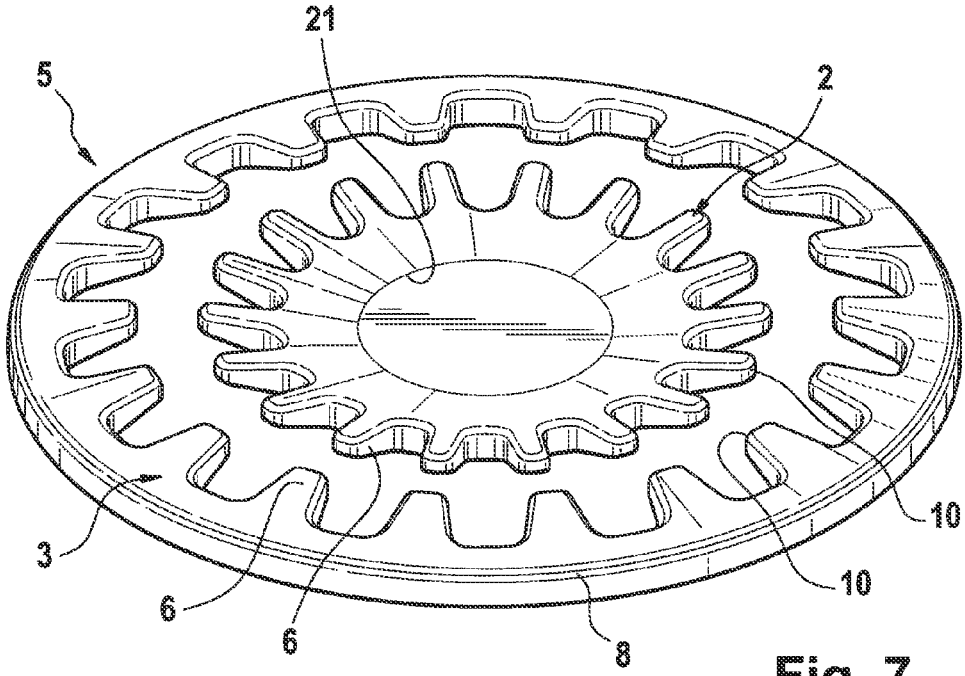
FIG. 7 shows an upper cutter according to the invention to be used in shavers of the rotating type and FIG. 8 is a cross-section through the embodiment according to FIG. 7.

FIG. 7 shows an outer cutter 5 of a shaving unit according to the invention to be used in shavers of the rotating type with a rotating inner cutter of a type known per se and not shown in the drawing. Also this outer cutter 5 provides inwardly directed teeth 6 of two comb elements 2 and 3. The first comb element 2 shows the form of a circle and the second comb element 3 has a ring-form and is arranged concentrically around the first comb element 2. The geometry and the dimensions as well as the function, the effects and the advantages of this embodiment of the invention are analog to the linear version depicted above and shown in the FIGS. 1 to 6.

Figure 8:
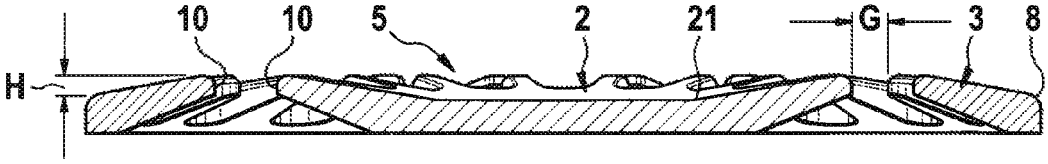

As can be taken from the cross section in FIG. 8 the teeth 6 are bent to an angle in a manner that the tips 10 are elevated about a height H of 250 μm relative to the level of the outer border 8 and the inner border 21. The free gap G between two opposite tips 10 is around 1.00 mm The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A shaving unit for an electric shaver, comprising an outer cutter and an inner cutter associated to said outer cutter, the outer and inner cutters being mounted so as to be movable relative to each other and adapted to be set in a relative motion by a drive mechanism, the inner cutter providing a plurality of cutting edges and abutting with its outer face on the inner face of the outer cutter and the outer cutter providing a plurality of teeth equipped with cutting edges, wherein the outer cutter provides two comb elements that are disposed opposite one another and that extend according to the direction of the relative motion, the two comb elements being aligned with respect to one another such that the tips of the teeth of the first comb element are facing the tips of the teeth of the second comb element, with the tips of the teeth being essentially spaced from one another.

2. The shaving unit of claim 1, wherein the teeth of the first comb element are arranged offset in relation to the teeth of the second comb element along the direction of the relative motion.

3. The shaving unit of claim 2, wherein the pitch (P) of the teeth of the two comb elements is about equal and that teeth of the first comb element are provided offset in relation to the second comb element essentially by half of the pitch.

4. The shaving unit of claim 1, wherein the teeth of the first and of the second comb element lie in one common plane.

5. The shaving unit of claim 1, wherein the teeth of the first and second comb elements each lie in planes that extend at an angle (A) of about 180-120 degrees to each other.

6. The shaving unit of claim 1, wherein the distance (G) between facing teeth tips is about 0.7 to 1.6 millimeters.

7. The shaving unit of claim 1, wherein the tips of the teeth have a width of about 150-800 μm and a height of about 50-300 μm.

8. The shaving unit of claim 1, wherein the inner cutter is provided with a recess in its area between the tips of the teeth of the outer cutter.

9. The shaving unit of claim 1, wherein the relative motion of the inner and outer cutter is a translational oscillating motion along the longitudinal axis (X) of the shaving unit.

10. The shaving unit of claim 1, wherein the relative motion of the inner and outer cutter is a rotatory motion around the perpendicular axis of the annular-shaped shaving unit.

11. The shaving unit of claim 1, wherein at least one of the two comb elements is provided with a bar arranged opposite the tips of the teeth.

12. A shaving head for an electric shaver, the shaving head comprising at least one of the shaving units of claim 1.

* * * * *